US010944164B2

(12) United States Patent
Cooley et al.

(10) Patent No.: US 10,944,164 B2
(45) Date of Patent: Mar. 9, 2021

(54) REFLECTARRAY ANTENNA FOR TRANSMISSION AND RECEPTION AT MULTIPLE FREQUENCY BANDS

(71) Applicants: Michael E. Cooley, Severna Park, MD (US); Bret J. Yon, Bowie, MD (US)

(72) Inventors: Michael E. Cooley, Severna Park, MD (US); Bret J. Yon, Bowie, MD (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 0 days.

(21) Appl. No.: 16/352,489

(22) Filed: Mar. 13, 2019

(65) Prior Publication Data

US 2020/0295446 A1 Sep. 17, 2020

(51) Int. Cl.
*H01Q 1/38* (2006.01)
*H01Q 21/06* (2006.01)

(52) U.S. Cl.
CPC ..... *H01Q 1/38* (2013.01); *H01Q 21/062* (2013.01); *H01Q 21/065* (2013.01)

(58) Field of Classification Search
CPC ..... H01Q 1/38; H01Q 21/065; H01Q 21/062
USPC ..... 343/812
See application file for complete search history.

(56) References Cited

U.S. PATENT DOCUMENTS 3,148,370 A 9/1964 Bowman
3,681,771 A 8/1972 Lewis et al.
3,852,765 A 12/1974 Bresler et al.
4,797,682 A 1/1989 Klimczak
4,905,014 A 2/1990 Gonzalez et al.
5,155,050 A 10/1992 Bayraktaroglu
5,400,042 A * 3/1995 Tulintseff ..... H01Q 21/24 343/727
5,459,123 A 10/1995 Das
5,483,246 A 1/1996 Barnett et al.
(Continued)

FOREIGN PATENT DOCUMENTS

EP 1544963 A1 6/2005
JP 2001-36306 2/2001
(Continued)

OTHER PUBLICATIONS

Non Final Office Action for U.S. Appl. No. 15/693,139 dated Apr. 17, 2020.

(Continued)

*Primary Examiner* — Don P Le
(74) *Attorney, Agent, or Firm* — Tarolli, Sundheim, Covell & Tummino LLP

(57) ABSTRACT

A reflectarray antenna includes a plurality of antenna conductors patterned on two or more planar surfaces. The antenna conductors include a first set of antenna conductors having a geometric arrangement to beamform and radiate a first wireless signal over a first frequency band. A second set of antenna conductors have a geometric arrangement to beamform and radiate a second wireless signal over a second frequency band that is distinct from the first frequency band. The first set of antenna conductors are formed on the two or more planar surfaces to enable operation at the first frequency band. The second set of antenna conductors are formed on the two or more planar surfaces to enable the second frequency band.

21 Claims, 8 Drawing Sheets

(56) References Cited

U.S. PATENT DOCUMENTS

| | | | | |
|---|---|---|---|---|
| 5,892,485 | A | 4/1999 | Glabe et al. | |
| 6,147,647 | A | 11/2000 | Tassoudji et al. | |
| 6,366,184 | B1 | 4/2002 | Ohtonen | |
| 6,426,727 | B2 | 7/2002 | Gilbert | |
| 6,501,426 | B2 | 12/2002 | Waterman | |
| 6,737,936 | B2 | 5/2004 | Noguchi | |
| 6,831,601 | B1 | 12/2004 | Lopez et al. | |
| 6,864,763 | B2 | 3/2005 | Brown et al. | |
| 6,967,624 | B1 | 11/2005 | Hsu et al. | |
| 6,999,034 | B1 | 2/2006 | Tsai et al. | |
| 7,154,451 | B1 | 12/2006 | Sievenpiper | |
| 7,907,090 | B2 | 3/2011 | Bershadsky et al. | |
| 8,144,059 | B2 | 3/2012 | Lynch | |
| 8,217,847 | B2 | 7/2012 | Sotelo et al. | |
| 8,508,319 | B1 | 8/2013 | Newsham et al. | |
| 8,665,040 | B1 | 3/2014 | Chappell et al. | |
| 8,736,505 | B2 | 5/2014 | Lambert et al. | |
| 10,256,545 | B2 * | 4/2019 | Boryssenko | H01Q 1/48 |
| 10,547,118 | B2 * | 1/2020 | Guntupalli | H01Q 9/0485 |
| 2001/0054978 | A1 | 12/2001 | Adachi et al. | |
| 2003/0137456 | A1 * | 7/2003 | Sreenivas | H01Q 21/065 343/700 MS |
| 2004/0004580 | A1 | 1/2004 | Toland et al. | |
| 2004/0046623 | A1 | 3/2004 | Brown et al. | |
| 2005/0285808 | A1 | 12/2005 | Holter | |
| 2006/0006966 | A1 | 1/2006 | Kang et al. | |
| 2006/0038732 | A1 | 2/2006 | DeLuca et al. | |
| 2006/0232479 | A1 * | 10/2006 | Walton | H01Q 5/42 343/700 MS |
| 2007/0287634 | A1 | 12/2007 | Lin et al. | |
| 2008/0030416 | A1 * | 2/2008 | Lee | H01Q 1/1292 343/754 |
| 2008/0111757 | A1 * | 5/2008 | Bisiules | H01Q 5/48 343/799 |
| 2008/0238790 | A1 | 10/2008 | McGrath et al. | |
| 2009/0079645 | A1 | 3/2009 | Sotelo et al. | |
| 2009/0243762 | A1 | 10/2009 | Chen et al. | |
| 2010/0085272 | A1 | 4/2010 | Legay et al. | |
| 2010/0220036 | A1 | 9/2010 | Maruyama et al. | |
| 2011/0059688 | A1 * | 3/2011 | Noonan | H04K 3/80 455/1 |
| 2012/0280872 | A1 | 11/2012 | Werner et al. | |
| 2013/0038495 | A1 | 2/2013 | Benzel et al. | |
| 2013/0214980 | A1 | 8/2013 | Lambert et al. | |
| 2013/0328635 | A1 | 12/2013 | Sekiguchi | |
| 2014/0218251 | A1 | 8/2014 | Waschenko et al. | |
| 2014/0231266 | A1 | 8/2014 | Sherrer et al. | |
| 2014/0285394 | A1 | 9/2014 | Truthan | |
| 2015/0162663 | A1 | 6/2015 | Boryssenko et al. | |
| 2015/0162665 | A1 | 6/2015 | Boryssenko et al. | |
| 2016/0164155 | A1 | 6/2016 | Wang et al. | |
| 2016/0211585 | A1 * | 7/2016 | Chau | H01Q 21/062 |
| 2019/0013592 | A1 * | 1/2019 | West | H01O 21/065 |
| 2019/0020114 | A1 | 1/2019 | Paulotto et al. | |
| 2019/0260137 | A1 * | 8/2019 | Watanabe | H01Q 5/42 |
| 2019/0279950 | A1 | 9/2019 | Kim et al. | |
| 2019/0319369 | A1 * | 10/2019 | Chiang | H01Q 1/243 |
| 2020/0106158 | A1 * | 4/2020 | Gomez Angulo | H01Q 1/521 |
| 2020/0106178 | A1 * | 4/2020 | Chou | H01Q 9/42 |
| 2020/0112081 | A1 | 4/2020 | Kim et al. | |
| 2020/0185826 | A1 * | 6/2020 | Park | H01Q 1/526 |

FOREIGN PATENT DOCUMENTS

| | | | |
|---|---|---|---|
| JP | 2014-527474 | A | 10/2014 |
| WO | 2014/117259 | A1 | 8/2014 |

OTHER PUBLICATIONS

Joel D Barrera et al: "Analysis of a Variable SIW Resonator Enabled by Dielectric Material Perturbations and Applications", IEE Transactions on Microwave Theory and Techniques, IEEE Service Center, Piscataway, NJ, US, vol. 61, No. I, Jan. 1, 2013 (Jan. 1, 2013), pp. 225-233, XPOI1488059, ISSN: 0018-9480, DOI: 10.1109/TMTT. 2012.2226052 *Fig. 3 and B. Variable SIW Resonator at pp. 226-227*.

Park J et al: "Low-loss, tunable microwave capacitors using bismuth zinc niobate thin films", Applications of Ferroelectrics, 2004. ISAF-04. 2004 14th IEEE International Symposium on Montreal, Canada Aug. 23-27, 2004, Piscataway, NJ, USA, IEEE, Aug. 23, 2004 (Aug. 23, 2004), pp. 17-20, XP010784487, DOI:10.1109/ISAF.2004. 1418327 ISBN: 978-0-7803-8410-1 *abstract; figure 1*.

European Search Report for Application No. 17 151 950.7-1205 dated Jul. 22, 2019.

Church, Additive Manufacturing: The Next Frontier for Research, Business and Opportunity, NSF workshop on Frontiers of Additive manufacturing Research and education, U.S., National Science Foundation, Jul. 12, 2013, pp. 1-27, URL, http://nsfam.mae.ufl.edu/Slides/Church.pdf.

Japanese Office Action corresponding to Japanese Application No. 2018-510348 dated Feb. 26, 2019.

European Examination Report corresponding to European Application No. 16754100.2 dated Feb. 27, 2019.

Entesari Kam Ran et al: 11 Tunab le SIW Structures: Antennas, VCOs, and Filters, IEEE Microwave Magazine, IEEEservice Center, Piscataway, NJ, US, vol. 16, No. 5, Jun. 1, 2015 (Jun. 1, 2015),pp. 34-54, XP011580297, ISSN: 1527-3342, DOI: 10.1109/MMM.2015.2408273 [retrieved on May 6, 2015]* p. 49,; figure 10 *.

European Search Report for Application No. 20157215.3-1205 dated Jun. 29, 2020.

Final Office Action for U.S. Appl. No. 15/693,139 dated Sep. 9, 2020.

* cited by examiner

REFLECTARRAY ANTENNA FOR TRANSMISSION AND RECEPTION AT MULTIPLE FREQUENCY BANDS

TECHNICAL FIELD

This disclosure relates to antennas, and more particularly to antennas having two or more planar surfaces that utilize different sizes and arrangements of antenna conductors on the surfaces to enable separate frequency bands to be concurrently transmitted and/or received via the antenna.

BACKGROUND

In telecommunications and radar, a reflective array (e.g., reflectarray) antenna is a class of directive antennas in which multiple driven elements are mounted in front of a ground plane designed to reflect and collimate the radio waves in a desired direction. Fixed beam reflectarrays can be constructed by invoking proper phasing of the surface elements (above a ground plane) to emulate the performance of a conventional parabolic antenna. Fixed beam reflectarray antennas generally have a large number of passive elements, fed by a feed of some type, in front of a large reflecting ground plane to produce a focused unidirectional beam of radio waves, with increased antenna gain and reduced radiation in unwanted directions.

SUMMARY

This disclosure relates to antennas, and more particularly to a reflectarray antenna having one or more planar surfaces that utilize different sized antenna conductors that are interspersed with each other within a given area to enable separate frequency bands to be concurrently transmitted and received at the antenna. In one example, an antenna includes a plurality of antenna conductors patterned on two or more planar surfaces. The antenna conductors include a first set of antenna conductors having a geometric arrangement to beamform and radiate a first wireless signal over a first frequency band. A second set of antenna conductors have a geometric arrangement to beamform and radiate a second wireless signal over a second frequency band that is distinct from the first frequency band. The first set of antenna conductors are formed on the two or more planar surfaces to enable operation at the first frequency band. The second set of antenna conductors are formed on the two or more planar surfaces to enable the second frequency band. The second set of antenna conductors are interspersed within an area defined by the first set of antenna conductors such that the antenna forms beams at the first and second frequency bands, and transmits and receives the first and second wireless signals concurrently.

In another example, a system includes a reflectarray having two or more membrane layers. A plurality of reflectarray conductors are patterned on the membrane layers. The reflectarray conductors include a first set of dipole conductors having a geometric arrangement that is configured to radiate a first wireless signal having a first frequency band and a second set of dipole conductors having a geometric arrangement that is configured to radiate a second wireless signal having a second frequency band that is different from the first frequency band. At least a portion of the first set of dipole conductors includes a folded extension patterned on a planar surface of the two or more membrane layers such that the reflectarray can transmit and receive the first and second wireless signals concurrently.

In yet another example, a method includes forming a first set of dipole conductors as a cross pattern on a first planar surface of a reflectarray to radiate a first wireless signal having a first frequency band. The method includes forming a second set of dipole conductors having an x-pattern on a second planar surface to radiate a second wireless signal having a second frequency band that is different from the first frequency band. The method includes positioning the second set of dipole conductors on the second surface within a common area defined by the first set of dipole conductors on the first planar surface such that the reflectarray can transmit and receive the first and second wireless signals concurrently. The first set of dipole conductors is formed from a first set of antenna conductors having first conductor lengths on the first planar surface to enable operation at the first frequency band. The second set of antenna conductors have second conductor lengths on the second surface that are less than the lengths of the first set of conductor lengths on the first planar surface to enable operation at the second frequency band.

DETAILED DESCRIPTION

The present disclosure relates to a reflectarray antenna and system having two or more planar surfaces that utilize different sized antenna elements that are interspersed with each other within a given area of the planar surfaces to enable separate frequency bands to be concurrently transmitted and received at the antenna. The reflectarray includes multiple sets of reflectarray conductors that are configured to provide selective fixed phase delays of wireless signals to provide collimated beams for transmission or reception of dual-band wireless signals. The reflecting conductors can be arranged on a flat surface or a membrane, such that they can provide selective fixed phase delays of the wireless signals to substantially emulate parabolic reflector antennas including single or multi-reflector systems, such as Cassegrain or Gregorian antenna systems, for example. The surfaces can be configured with multiple layers. In one example, a first membrane layer, a second membrane layer, and a third membrane layer are each offset from one another by a predetermined distance, such that a first of the membrane layers includes the reflectarray phasing conductors, and the second and third membranes correspond to ground planes for the respective frequency bands. In another example, the sets of reflectarray phasing conductors may be realized on separate membrane layers and thus the reflectarray can be composed of four layers with two layers of the membrane dedicated to the reflectarray elements and two layers providing different types of ground planes for the respective conductors (e.g., dipole conductors).

The reflectarray conductors can have varying dimensions and geometry with respect to each other, such that the reflectarray conductors can be transparent to wireless signals of certain wavelengths, and can provide selective fixed phase delays to wireless signals of other wavelengths. In addition, some of the reflectarray conductors can be patterned as larger elements that are coplanar with and surrounded by the smaller elements in a common are of a three-dimensional planar configuration, such that the smaller conductors occupy a geometric area of the surface of the membrane that is associated with the larger conductors. The larger reflectarray conductors can be configured as crossed-dipoles with extensions that are folded back toward a center, such as to increase an effective wavelength of the respective dipole conductor. Accordingly, the reflectarray antenna can provide multi-band wireless transmission concurrently in multiple frequency bands, such as in a satellite communication platform, with substantially reduced hardware to provide a more compact and more cost-effective communication platform.

Figure 1:
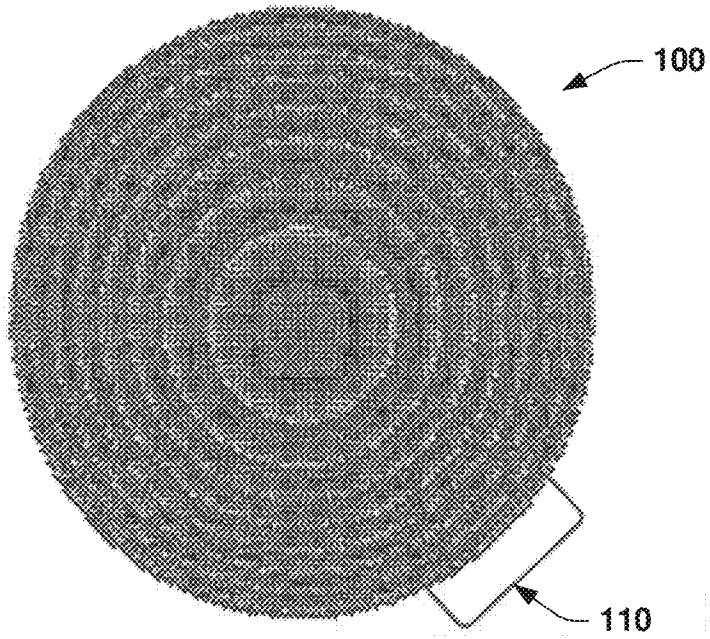
FIG. 1 illustrates a top-view of an example of an antenna incorporating multiple feeds and multiple membrane surfaces with varying conductor sizes to provide concurrent operation at least at two frequency bands.

FIG. 1 illustrates a top-view of an example of an antenna 100 incorporating multiple feeds and multiple surfaces with varying conductor sizes to provide concurrent operation at least at two frequency bands. The antenna 100 (also referred to as reflectarray antenna) includes one or more planar surfaces beneath the top-surface shown that utilize different sized antenna conductors that are interspersed with each other within a given area of the antenna to enable separate frequency bands to be concurrently transmitted and received at the antenna. The antenna 100 includes a plurality of conductors (e.g., dipole conductors) patterned on one or more planar surfaces. In one example, the conductors can be patterned on the same layer and in other examples on separate layers. Each of the different layers described herein can be physically coupled to form a surface or membrane to transmit and receive wireless signals over multiple frequency bands. As used herein, the term membrane refers to a flexible and reflective material having dipoles patterns fabricated therein.

The antenna conductors described herein can be patterned on the various membrane layers described herein of the antenna 100, include a first set of antenna conductors having a geometric arrangement to beamform, and radiate a first wireless signal over a first frequency band. A second set of antenna conductors within the membrane layers of the antenna 100 have a geometric arrangement to beamform and radiate a second wireless signal over a second frequency band that is distinct from the first frequency band. The first set of antenna conductors are formed on the two or more planar surfaces of the antenna 100 to enable operation at the first frequency band. The second set of antenna conductors are formed on the two or more planar surfaces of the antenna 100 to enable the second frequency band. The second set of antenna conductors are interspersed within an area defined by the first set of antenna conductors such that the antenna forms beams at the first and second frequency bands, and transmits and receives the first and second wireless signals concurrently.

Figure 4:
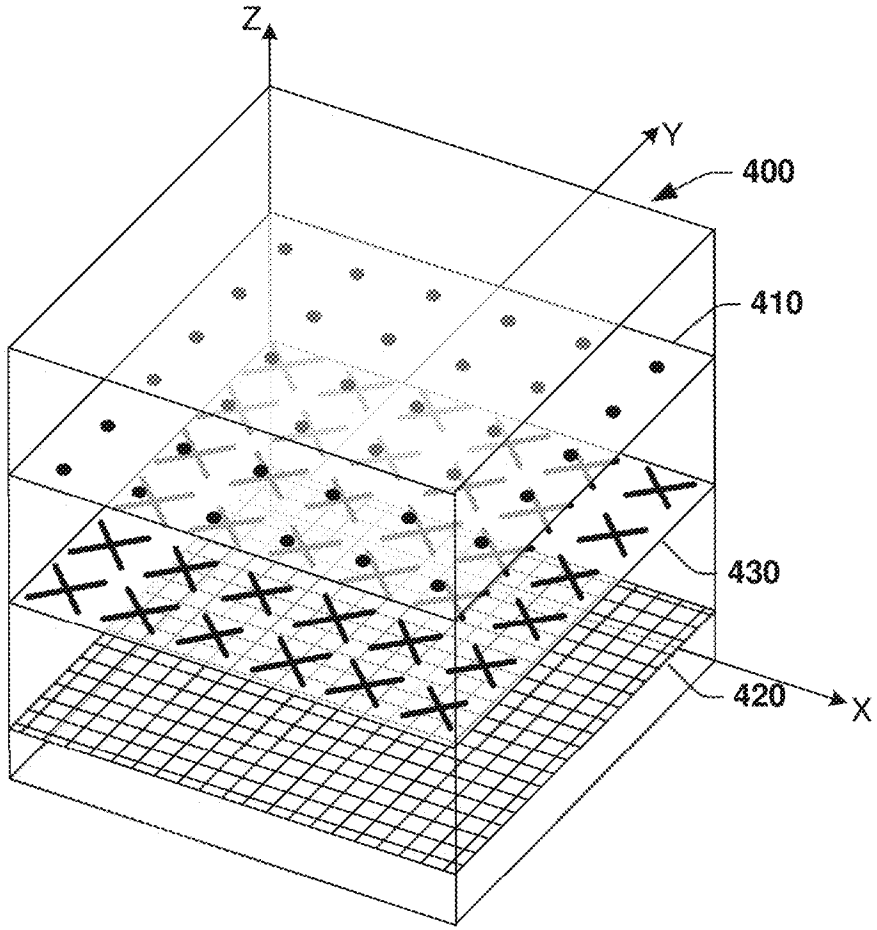
FIG. 4 illustrates an example of a membrane having multiple layers that provide operation at least at two different frequency bands.

As used herein, the term area refers to a region on a membrane layer where one type of dipole pattern is formed thereon. Such a region of the antenna 100 could be patterned as a quadrant (e.g., four portions delineated in one area of the membrane). On the same or subsequent membrane layers in the horizontal structure of the antenna 100 such as shown in FIG. 4, for example, other dipole patterns can be dispersed within the same area even though the other dipole patterns may reside on another layer of the horizontal structure. For example, the dipole patterns described herein can include at least one of an x-pattern dipole, a cross-pattern dipole, a square-patch dipole, a rectangular-patch dipole, a metallic-disk dipole, and a metallic-ring dipole having a non-metallic portion as a center portion of the metallic ring. In one example, a cross dipole area of the antenna 100 may define four quadrants where x-patterns are dispersed within the quadrants defined by the cross dipole. In another example, an x-pattern dipole may define separate quadrants where cross-pattern dipoles are interspersed within the quadrants defined by the x-pattern. By patterning differing types of dipole patterns within an area defined by another pattern (e.g., on the same membrane layer or different membrane layers), multiple wireless signals of different signal frequencies can be transmitted and/or received concurrently by the antenna 100. A section 110 of the antenna 100 is shown as an enlarged portion in FIG. 2.

Figure 2:
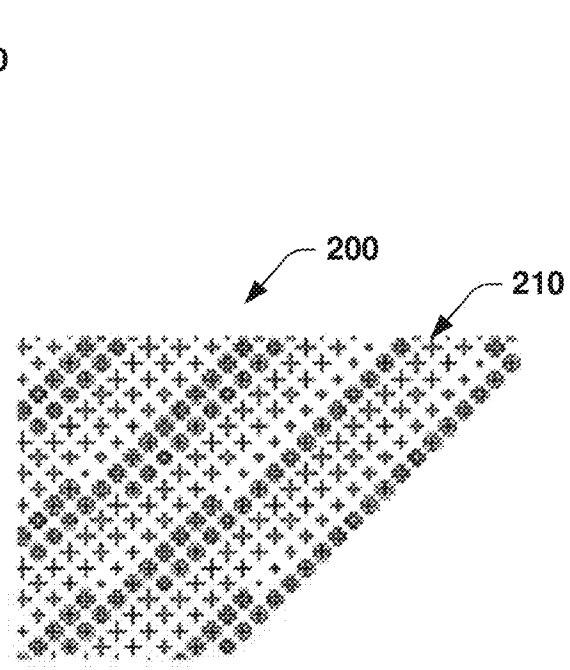
FIG. 2 illustrates an enlarged portion from the antenna depicted in FIG. 1.

FIG. 2 illustrates an enlarged portion 200 from the antenna section 110 depicted in FIG. 1. In this example, various cross dipole elements are shown fabricated on a portion if the antenna depicted in FIG. 1. An example cross dipole among a plurality of dipoles is shown at 210. As mentioned previously, various patterns can be patterned within the enlarged portion 200 including the cross dipoles shown. These dipole patterns can include for example, x-pattern dipoles, square patch dipoles, rectangular patch dipoles, metallic disk dipoles, metallic ring dipoles having a non-metallic portion as a center portion of the metallic rings. The dipole patterns shown in the enlarged portion 200 can include a first set of dipole conductors having a geometric arrangement to radiate a first wireless signal having a first frequency band and a second set of dipole conductors (e.g., on the same or different membrane layers) having a geometric arrangement to radiate a second wireless signal having a second frequency band that is distinct from the first frequency band. The first set of dipole conductors can be formed as a set of cross-patterns such as shown at 210 on the one or more planar surfaces via a first antenna conductor that is patterned in an X and a Y direction within a given area of the membrane surface in which it is patterned. The first antenna conductor has a first conductor size and/or shape to enable the first frequency band described herein. As used herein, the first conductor size refers to the combined conductor lengths of both the X and Y components of the first conductor cross-pattern.

Figure 3:
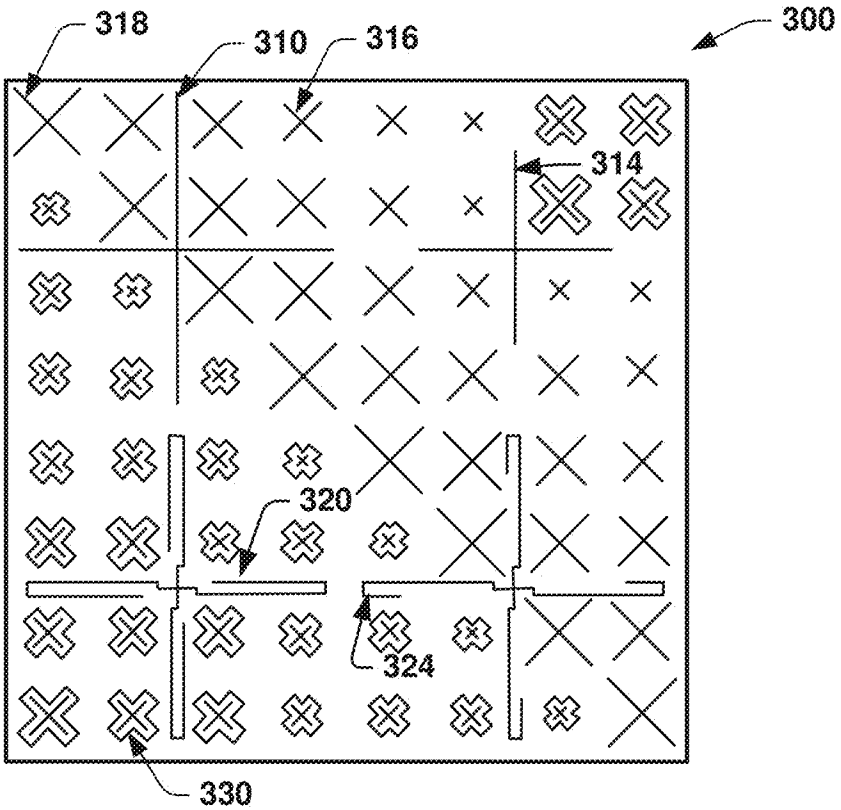
FIG. 3 illustrates examples of a two-layer membrane structure viewed from the top where a larger dipole pattern is formed on a lower layer and a smaller dipole pattern is formed on the top layer and overlaid on the lower layer.

The second set of dipole conductors can be formed as x-patterns on the one or more planar surfaces of the antennas described herein. The second set of dipole conductors is generally smaller in size than the first set, which enables operation at the second frequency band. As used herein, the size of the dipoles in the second set refers to the combined conductor lengths of the X and Y components of the conductor x-patterns. The x-pattern can be similar to the cross-pattern in that it can be composed of two overlapping conductors at right angles to each other. In this example, the x-pattern (not shown, see e.g., FIG. 3) is can be a cross-pattern that is rotated 45 degrees from the cross-pattern of the first dipole conductors. In another example, the first dipole conductors could be rotated into an x-pattern whereas the second dipole conductors can be implemented as a cross-pattern within the given area. As shown in FIG. 3 below, the second set of dipole conductors can be interspersed within the area defined by the first set of dipole conductors on the one or more planar surfaces of the antenna to enable transmitting and receiving the first and second wireless signals concurrently.

In one example, the first dipole conductor set can be configured via the first conductor length on the one or more planar surfaces of the antenna to operate at S-Band (approximately 3.0 GHz) within the radio frequency spectrum. And, the second set of second dipole conductors can be configured via the second conductor lengths on the one or more planar surfaces to operate at X-Band (approximately 9.0 GHz). The plurality of dipole conductors can include loop dipole elements (not shown) and/or cross dipole elements. The size and/or the shapes of the first set of dipole conductors and the second set of dipole conductors can be varied across the one or more planar surfaces of the antenna to emulate a parabolic reflector antenna in an example.

The antennas described herein can incorporate at least two different sets of dipole conductors, the first of which provides operation at frequency band 1 and the second of which provides operation at frequency band 2, in an example. The conductor size refers to the xy extent or length of the dipole element and this can be varied across the membrane surfaces to provide desired antenna array phasing at each of the frequency bands. The nominal or average size of the first set of dipole conductors can be smaller than that of the second set of dipole conductors. This scaling or difference in average size enables operation at different frequency bands (e.g., at least two bands). The first and second sets of dipole conductors can be formed on the same planar membrane layer or formed on separate planar membrane layers as described herein. The term region defines a location on the multi-layer antenna surface where the given area is located. A plurality of such regions are provided to form the overall multi-layer antenna surface. Each region within a given area, which includes its own respective, can have dipole conductors that are sized and shaped differently from another region in order to more accurately emulate parabolic performance of the antenna.

Figure 5:
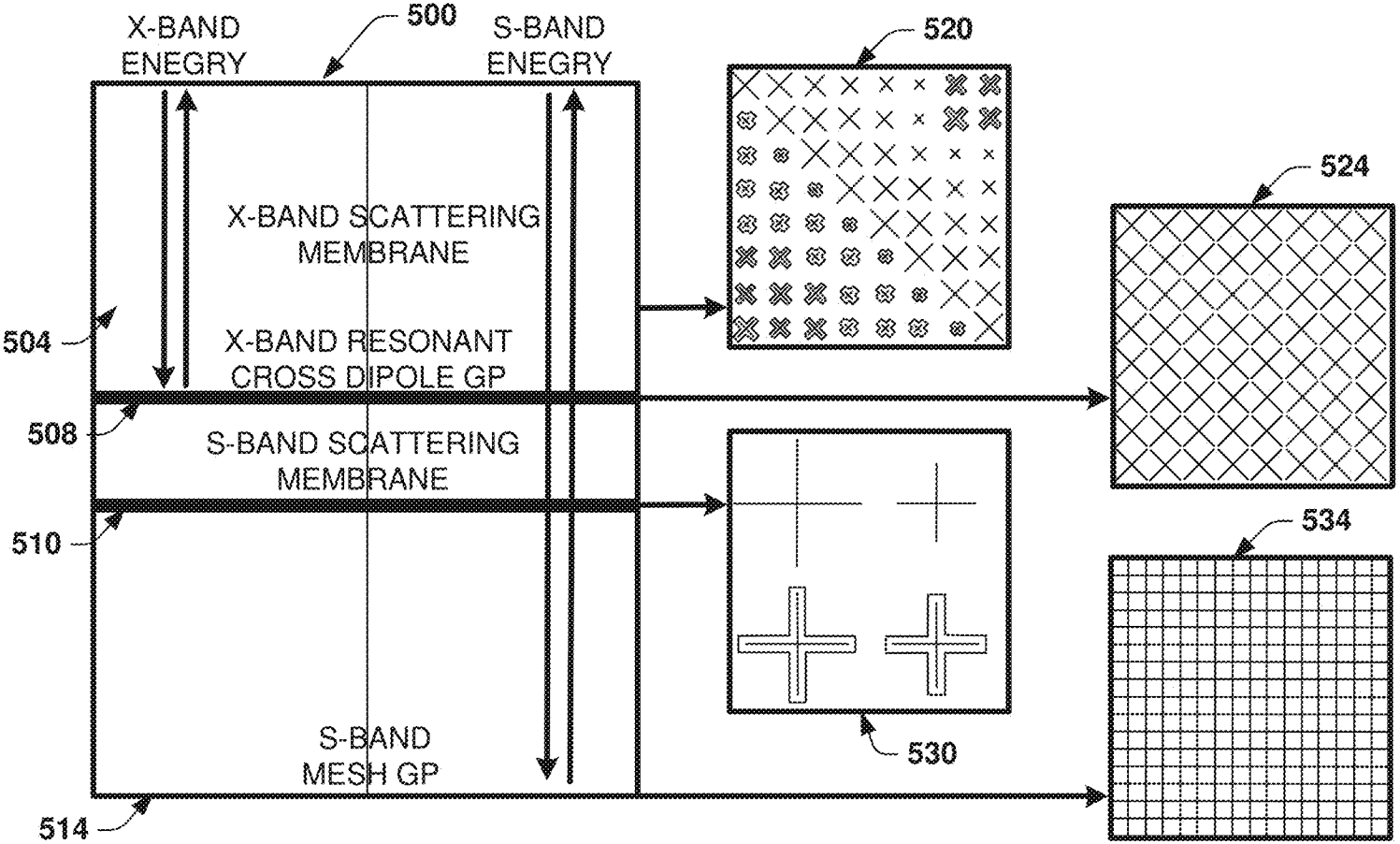
FIG. 5 illustrates an example four-layer membrane structure for an antenna to provide concurrent operation at least at two frequency bands.
Figure 6:
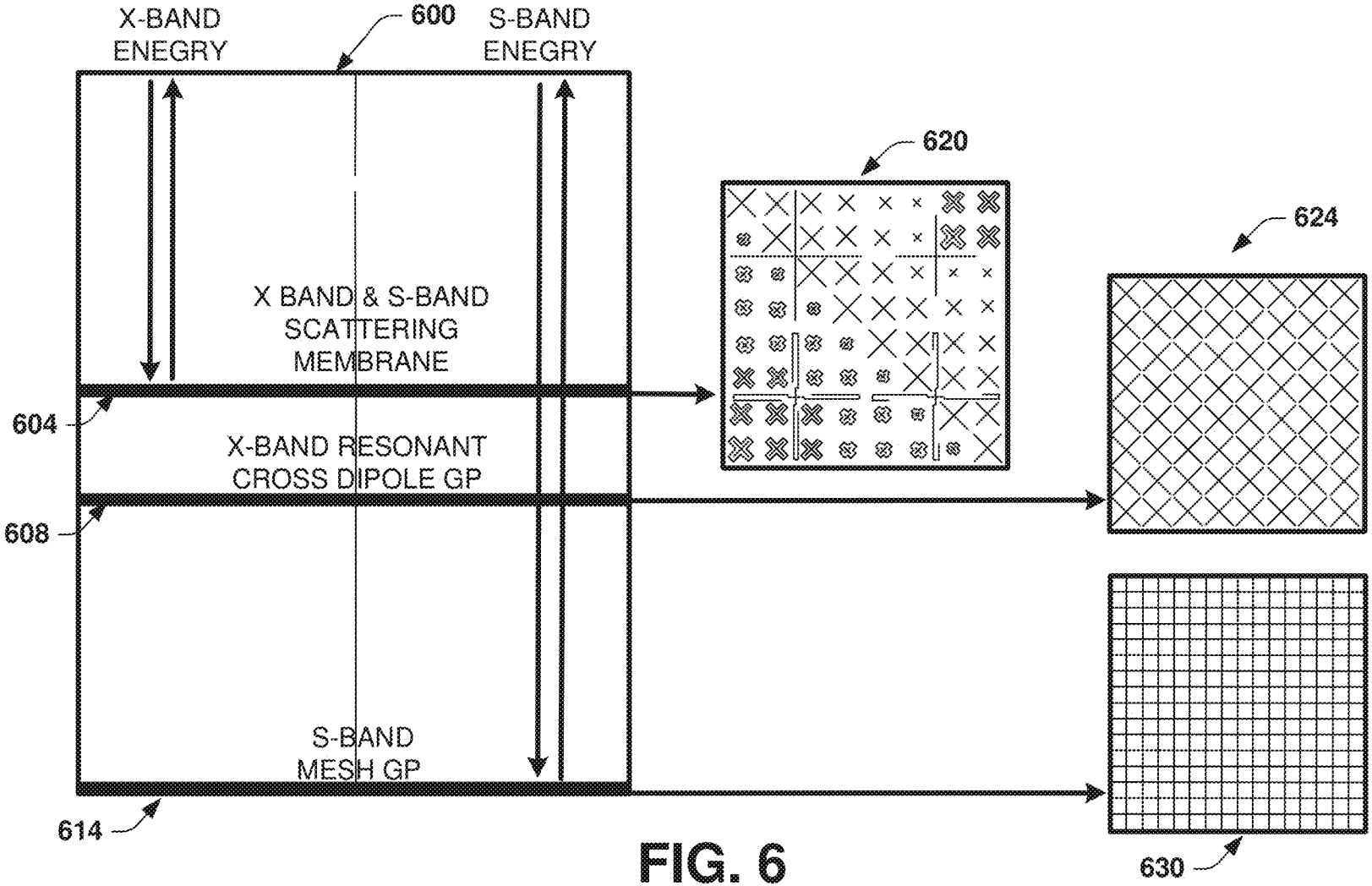
FIG. 6 illustrates an example three-layer membrane structure for an antenna to provide concurrent operation at least at two frequency bands.

FIG. 3 illustrates examples of a two-layer membrane structure forming a portion of an antenna 300 (without ground planes such as shown in FIGS. 5 and 6) and viewed from the top where a larger dipole pattern is formed on a lower layer and a smaller dipole pattern is formed on the top layer and overlaid on the lower layer. The antenna 300 includes a plurality of antenna conductors patterned on two or more planar surfaces. The antenna conductors include a first set of antenna conductors (e.g., formed on the bottom membrane layer) such as shown at 310 and 314 having a geometric arrangement to beamform and radiate a first wireless signal over a first frequency band. A second set of antenna conductors such as shown at 316 and 318 (formed on the top membrane layer) have a geometric arrangement to beamform and radiate a second wireless signal over a second frequency band that is distinct from the first frequency band. The first set of antenna conductors are formed on the two or more planar surfaces to enable operation at the first frequency band. The second set of antenna conductors are formed on the two or more planar surfaces to enable the second frequency band. As shown, the second set of antenna conductors such as shown at 316 and 318 are interspersed within an area defined by the first set of antenna conductors such as shown at 310 such that the antenna 300 forms beams at the first and second frequency bands, and transmits and receives the first and second wireless signals concurrently.

The first set of antenna conductors 310 or 314 or the second set of antenna conductors 316 and 318 include dipole conductors, for example. At least one of the first set of antenna conductors or the second set of antenna conductors are folded back toward a center point such as shown at 320 and 324 within the area to increase an effective wavelength of the respective dipole conductors. The first set of antenna conductors 310 or 314 and the second set of antenna conductors 316 and 318, for example, are formed on one or more planar membrane layers. The antenna conductors of the respective sets are arranged as dipole patterns and the membrane layers are sized in accordance with the dipole patterns to enable the antenna to form focused beams and to transmit and receive the first and second wireless signals concurrently. As mentioned previously, the dipole patterns can include at least one of an x-pattern dipole, a cross-pattern dipole, a square-patch dipole, a rectangular-patch dipole, a metallic-disk dipole, and a metallic-ring dipole having a non-metallic portion as a center portion of the metallic ring.

As will be shown in FIG. 5, a mesh ground plane membrane can be provided that operates in conjunction with at least one of the first set of antenna conductors 310/314 or the second set of antenna conductors 316/318 over the one or more planar membrane layers. A frequency selective ground plane membrane (see e.g., FIG. 5) can be provided that operates in conjunction with the first set of antenna conductors 310/314 or the second set of antenna conductors 316/318 over the one or more planar membrane layers, where the frequency selective ground plane has resonant conductive patterns that are electrically associated with the dipole patterns. The first set of antenna conductors 310 and 314 can be configured via a first set of conductor lengths on the two or more planar surfaces to operate in an S-Band of the frequency spectrum that operates between about 2 and 4 Gigahertz of the frequency spectrum, for example.

The second set of antenna conductors 316 and 318 are configured via a second set of conductor lengths on the two or more planar surfaces to operate in an X-Band of the frequency spectrum that operates between about 8 and 12.5 Gigahertz of the frequency spectrum. In one example, each of the second set of antenna conductors 316 and 318 can include loop dipole conductors and cross dipole conductors. The sizes or shapes of the first set of antenna conductors 310/314 and the second set of antenna conductors 316/318 can be varied and patterned across the two or more planar surfaces of the antenna 300 to emulate a parabolic reflector by generating focused beams at least two different frequency bands.

FIG. 4 illustrates an example of a membrane 400 having multiple layers that provide concurrent operation at least at two different frequency bands. In this example, the first and second sets of dipole conductors described herein are formed on the same membrane layer 410. As mentioned previously, the first and second sets of dipole conductors can alternatively be fabricated on separate closely space layers and positioned horizontally with respect to each other to provide analogous multi-band operation. A membrane mesh ground plane 420 can be provided that operates in conjunction with the first set of dipole conductors among a plurality of antenna regions spaced throughout the one or more planar membrane layers. For example, the mesh ground plane 420 can support L-Band frequencies in one example. A frequency selective ground plane membrane 430 can be provided that operates in conjunction with the second set of dipole conductors among the plurality of antenna regions spaced throughout the one or more planar membrane layers. The frequency selective ground plane 430 can include conductive resonant length conductors having a similar shape (e.g., x-pattern, cross pattern) of the second set of dipole conductors. In some examples, x-pattern dipoles and/or cross-pattern dipoles can have a surrounding metallic layer patterned in the shape of the respective dipole such as shown as 330.

FIG. 5 illustrates an example four-layer membrane structure for an antenna 500 to provide concurrent operation at least at two frequency bands. The antenna 500 includes an X-band scattering membrane 504 as the top layer, followed by an X-band resonant cross dipole ground plain 508 at the next lower level, followed by an S-band scattering membrane 510 at the next lower level, and subsequently followed by an S-band mesh ground plane 514 at the lowest membrane level of the antenna. As shown, X-band energy is transmitted between levels 504 and 508, whereas S-band energy is transmitted between all four levels. At the right of the antenna 500, the respective membrane layer 504 is shown patterned at 520, the layer 508 is shown patterned at 524, the layer 510 is shown patterned at 530, and the layer 514 is shown patterned at 534. The layers 504, 508, 510, and 514 can be arranged in different layers with respect to each other than the example layer structure shown for the example antenna 500.

FIG. 6 illustrates an example three-layer membrane structure for an antenna 600 to provide concurrent operation at least at two frequency bands. The antenna 600 includes an X-band and S-band scattering membrane 604 as the top layer, followed by an X-band resonant cross dipole ground plain 608 at the next lower level, and subsequently followed by an S-band mesh ground plane 614 at the lowest membrane level of the antenna. As shown, X-band energy is transmitted between levels 604 and 608, whereas S-band energy is transmitted between all three levels. At the right of the antenna 600, the respective membrane layer 604 is shown patterned at 620, the layer 608 is shown patterned at 624, and the layer 614 is shown patterned at 630. The layers 604, 608, and 614 can be arranged in different layers with respect to each other than the example layer structure shown for the example antenna 600.

Figure 7:
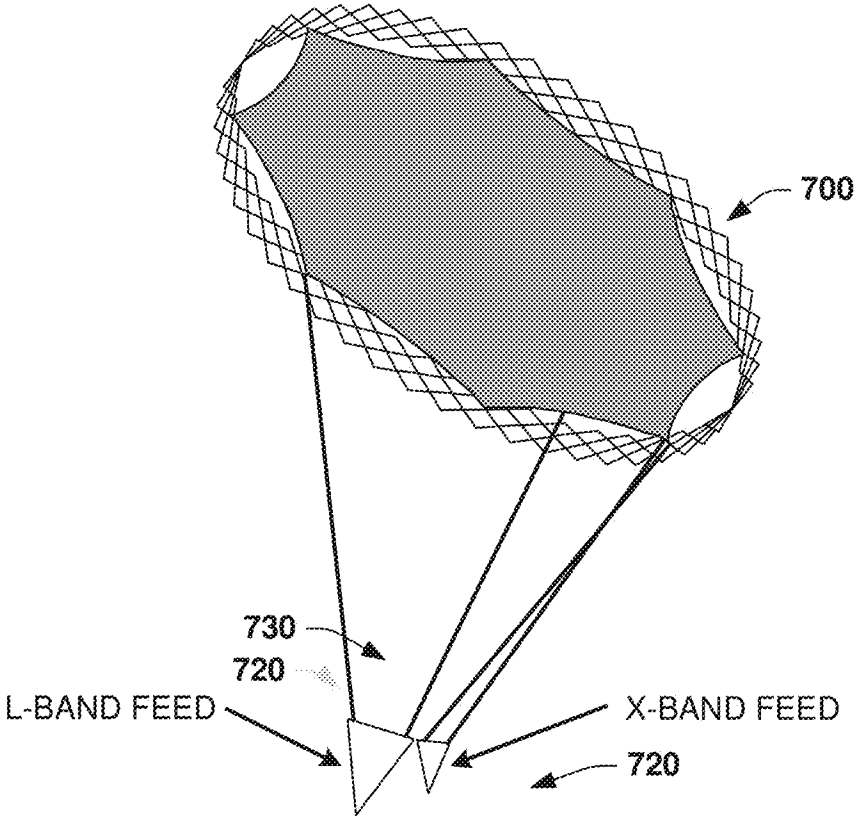
FIG. 7 illustrates an example system having a reflectarray with two or more planar surfaces.

FIG. 7 illustrates an example of a membrane 700 with reflectarray conductors patterned on one or more membrane layers of the membrane and a multi-band feed at 720 (e.g., X band) and 730 (e.g., L-band feed). The reflectarray conductors include a first set of dipole conductors having a geometric arrangement that is configured to radiate a first wireless signal having a first frequency band and a second set of dipole conductors having a geometric arrangement that is configured to radiate a second wireless signal having a second frequency band that is different from the first frequency band. In this example, at least a portion of the first dipole conductor set includes a folded extension (see e.g., FIG. 3) patterned in a planar manner on the one or more membrane layers 700 such that the reflectarray can transmit and receive the first and second wireless signals concurrently.

Figure 8:
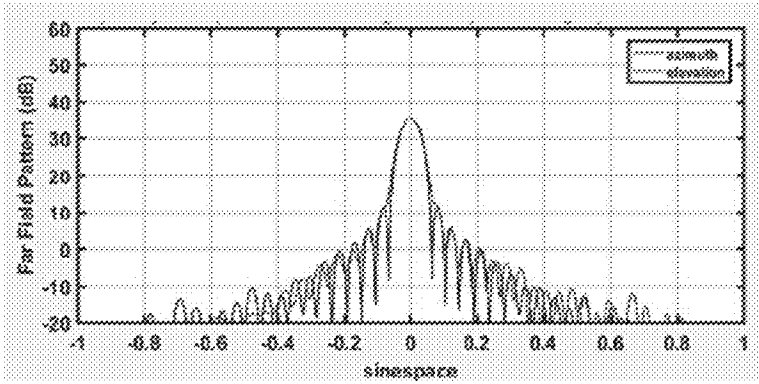
FIGS. 8 and 9 illustrate an example beam pattern associated with the first and second conductor sets of the reflectarray antenna described herein.
Figure 9:
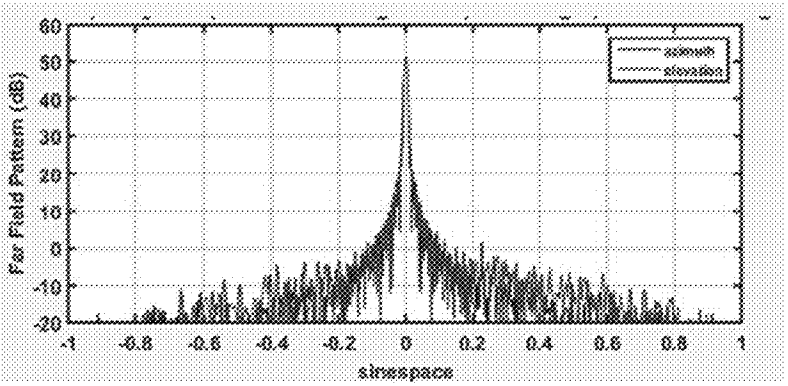

FIGS. 8 and 9 illustrate an example beam pattern associated with the first and second conductor sets (e.g., dipole sets) of the reflectarray antenna described herein. FIG. 8 illustrates an S-band pattern for the first set of dipole conductors described herein whereas FIG. 9 represents an X-band pattern for the second set of dipole conductors described herein. As mentioned previously, the S-band frequency operates between about 2 and 4 Gigahertz and the X-band frequency operates between about 8 and 12.5 Gigahertz.

Figure 10:
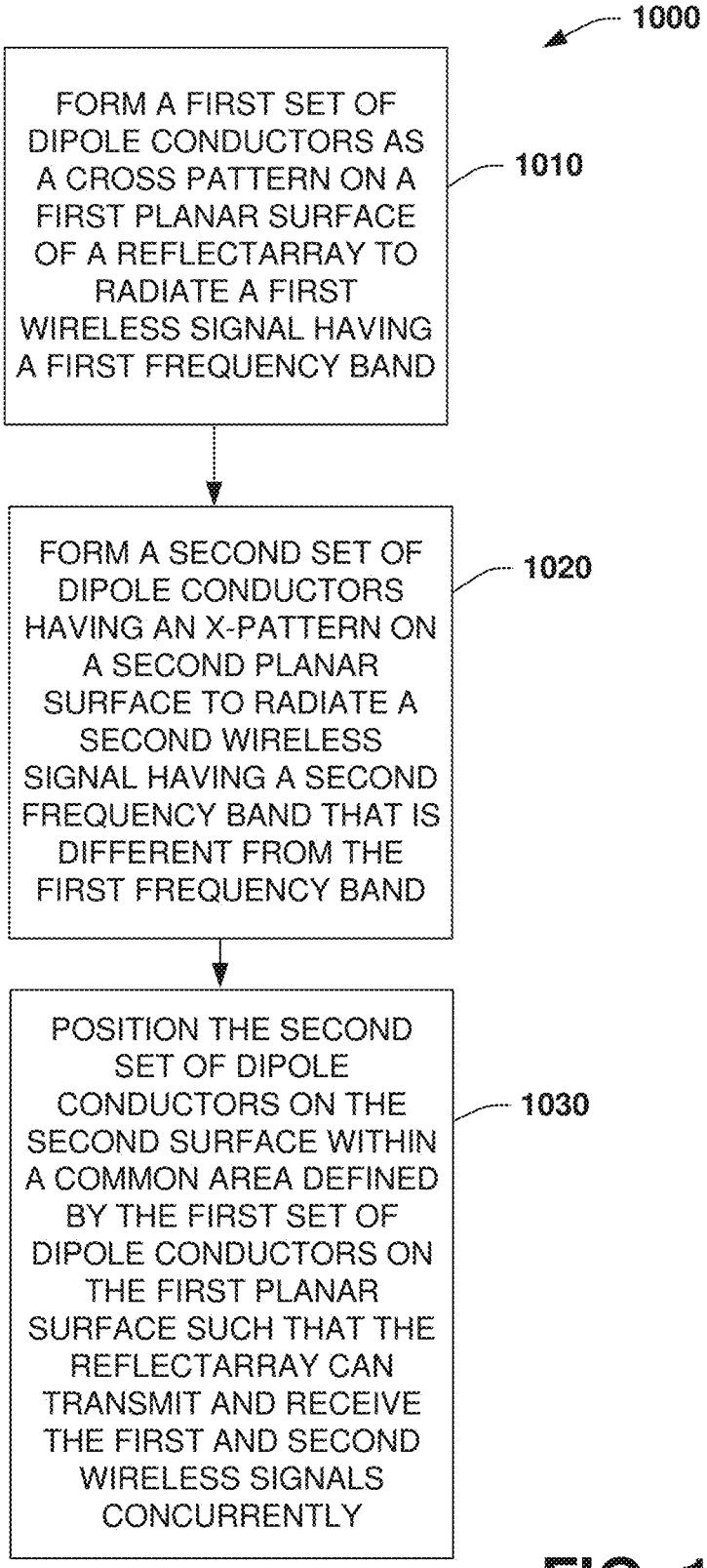
FIG. 10 illustrates an example method for forming a reflectarray antenna having planar surfaces that utilize different sets of antenna conductors that are interspersed within each other over a given area to enable separate frequency bands to be transmitted and received at the antenna.

FIG. 10 describes a method for forming a multi-band reflectarray. For purposes of simplicity of explanation, the method is shown and described as executing serially, it is to be understood and appreciated that the method is not limited by the illustrated order, as the method could occur in different orders and/or concurrently from that shown and described herein.

FIG. 10 illustrates an example method 1000 forming a reflectarray antenna from planar surfaces that utilize different sized antenna conductors that are interspersed with each other within a given area of the planar surfaces to enable separate frequency bands to be concurrently transmitted and received at the antenna. At 1010, the method 1000 includes forming a first set of dipole conductors as a cross pattern on a first planar surface of a reflectarray to radiate a first wireless signal having a first frequency band. At 1020, the method 1000 includes forming a second set of dipole conductors having an x-pattern on a second planar surface to radiate a second wireless signal having a second frequency band that is different from the first frequency band. At 1030, the method 1000 includes positioning the second set of dipole conductors on the second surface within a common area defined by the first set of dipole conductors on the first planar surface such that the reflectarray can transmit and receive the first and second wireless signals concurrently. The first set of dipole conductors is formed from a first set of antenna conductors having first conductor lengths on the first planar surface to enable operation at the first frequency band. The second set of antenna conductors have second conductor lengths on the second surface that are less than the lengths of the first set of conductor lengths on the first planar surface to enable operation at the second frequency band.

The first set of dipole conductors and the second set of dipole conductors can be formed on one or more planar membrane layers. The antenna conductors of the respective sets can be arranged as dipole patterns and the membrane layers are sized in accordance with the dipole patterns to enable the reflectarray antenna to form focused beams and to transmit and receive the first and second wireless signals concurrently.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An antenna, comprising:

a plurality of antenna conductors patterned on two or more planar surfaces, the antenna conductors comprising a first set of antenna conductors having a geometric arrangement to beamform and radiate a first wireless signal over a first frequency band and a second set of antenna conductors having a geometric arrangement to beamform and radiate a second wireless signal over a second frequency band that is distinct from the first frequency band, the first set of antenna conductors are formed on the two or more planar surfaces to enable operation at the first frequency band, the second set of antenna conductors are formed on the two or more planar surfaces to enable the second frequency band, wherein a plurality of the second set of antenna conductors is positioned in entirety within an area bounded by lateral extents of a respective one of the first set of antenna conductors in two orthogonal directions on the two or more planar surfaces such that the antenna forms beams at the first and second frequency bands, and transmits and receives the first and second wireless signals concurrently.

2. The antenna of claim 1, wherein the first set of antenna conductors or the second set of antenna conductors include dipole conductors, at least one of the first set of antenna conductors or the second set of antenna conductors are folded back toward a center point within the area to increase an effective wavelength of the respective dipole conductors.

3. The antenna of claim 1, wherein the first set of antenna conductors and the second set of antenna conductors are formed on one or more planar membrane layers, wherein the antenna conductors of the respective sets are arranged as dipole patterns and the membrane layers are sized in accordance with the dipole patterns to enable the antenna to form focused beams and to transmit and receive the first and second wireless signals concurrently.

4. The antenna of claim 3, wherein the dipole patterns include at least one of an x-pattern dipole, a cross-pattern dipole, a square-patch dipole, a rectangular-patch dipole, a metallic-disk dipole, and a metallic-ring dipole having a non-metallic portion as a center portion of the metallic ring.

5. The antenna of claim 3, further comprising a mesh ground plane membrane that operates in conjunction with at least one of the first set of antenna conductors or the second set of antenna conductors over the one or more planar membrane layers.

6. The antenna of claim 4, further comprising a frequency selective ground plane membrane that operates in conjunction with the first set of antenna conductors or the second set of antenna conductors over the one or more planar membrane layers, the frequency selective ground plane having resonant conductive patterns that are electrically associated with the dipole patterns.

7. The antenna of claim 1, wherein the first set of antenna conductors is configured via a first set of conductor lengths on the two or more planar surfaces to operate in an S-Band of the frequency spectrum that operates between about 2 and 4 Gigahertz of the frequency spectrum.

8. The antenna of claim 1, wherein the second set of antenna conductors are configured via a second set of conductor lengths on the two or more planar surfaces to operate in an X-Band of the frequency spectrum that operates between about 8 and 12.5 Gigahertz of the frequency spectrum.

9. The antenna of claim 8, wherein each of the second set of antenna conductors include loop dipole conductors and cross dipole conductors.

10. The antenna of claim 1, wherein the sizes or shapes of the first set of antenna conductors and the second set of antenna conductors are varied across the two or more planar surfaces to emulate a parabolic reflector by generating focused beams at least two different frequency bands.

11. The antenna of claim 1, wherein the first set of antenna conductors is arranged as a cross-pattern that defines four quadrants bounded by the lateral extents of the cross-pattern, wherein at least one of the second set of antenna conductors is dispersed in entirety within each of the quadrants of each antenna conductor of the first set of antenna conductors.

12. A system, comprising:

a reflectarray includes two or more membrane layers; and a plurality of reflectarray conductors patterned on the two or more layers of the membrane layers, the reflectarray conductors comprising a first set of dipole conductors having a geometric arrangement that is configured to radiate a first wireless signal having a first frequency band and a second set of dipole conductors having a geometric arrangement that is configured to radiate a second wireless signal having a second frequency band that is different from the first frequency band, wherein at least a portion of the first set of dipole conductors comprises a folded extension patterned on a planar surface of the two or more membrane layers such that the reflectarray can transmit and receive the first and second wireless signals concurrently.

13. The system of claim 12, wherein the first and second sets of dipole conductors are formed over the membrane, wherein the membrane enables the reflectarray antenna to form focused beams and transmit and receive the first and second wireless signals concurrently.

14. The system of claim 13, further comprising a mesh ground plane layer that operates in conjunction with the first set of dipole conductors over the membrane.

15. The system of claim 14, further comprising a frequency selective ground plane layer that operates in conjunction with the second set of dipole conductors over the membrane, the frequency selective ground plane having resonant conductive patterns that electrically correlate with the second set of dipole conductors.

16. The system of claim 12, wherein the first set of antenna conductors and the second set of antenna conductors are formed on one or more planar membrane layers, wherein the antenna conductors of the respective sets are arranged as dipole patterns and the membrane layers are sized in accordance with the dipole patterns to enable the reflectarray antenna to form focused beams and to transmit and receive the first and second wireless signals concurrently.

17. The system of claim 16, wherein the dipole patterns include at least one of an x-pattern dipole, a cross-pattern dipole, a square-patch dipole, a rectangular-patch dipole, a metallic-disk dipole, and a metallic-ring dipole having a non-metallic portion as a center portion of the metallic ring.

18. The system of claim 12, wherein the first set of dipole conductors is configured via a first set of conductor lengths on the planar surface to operate in an S-Band of the frequency spectrum that operates between about 2 and 4 Gigahertz of the frequency spectrum, and the second set of dipole elements are configured via the second set of conductor lengths on the planar surface to operate in an X-Band of the frequency spectrum that operates between about 8 and 12.5 Gigahertz of the frequency spectrum.

19. The system of claim 12, wherein the sizes or shapes of the first set of dipole conductors and the second set of dipole conductors are varied across the membrane to emulate a parabolic reflector by generating focused beams at two different frequency bands.

20. A method, comprising:

forming a first set of dipole conductors as a cross pattern on a first planar surface of a reflectarray to radiate a first wireless signal having a first frequency band;

forming a second set of dipole conductors having an x-pattern on a second planar surface to radiate a second wireless signal having a second frequency band that is different from the first frequency band, the second planar surface being parallel with and offset from the first planar surface; and positioning the second set of dipole conductors on the second surface within a common area defined by the first set of dipole conductors on the first planar surface such that the reflectarray can transmit and receive the first and second wireless signals concurrently, wherein the first set of dipole conductors is formed from a first set of antenna conductors having first conductor lengths on the first planar surface to enable operation at the first frequency band, and the second set of antenna conductors having second conductor lengths on the second planar surface that are less than the lengths of the first set of conductor lengths on the first planar surface to enable operation at the second frequency band.

21. The method of claim 20, wherein the first set of dipole conductors and the second set of dipole conductors are formed on one or more planar membrane layers, wherein the antenna conductors of the respective sets are arranged as dipole patterns and the membrane layers are sized in accordance with the dipole patterns to enable the reflectarray antenna to form focused beams and to transmit and receive the first and second wireless signals concurrently.

* * * * *